US007357729B2

(12) United States Patent
Berokoff

(10) Patent No.: US 7,357,729 B2
(45) Date of Patent: Apr. 15, 2008

(54) GOLF CLUB

(76) Inventor: Andrew J. Berokoff, 13922 Valna Ave., Whittier, CA (US) 89695

( * ) Notice: Subject to any disclaimer, the term of this patent is extended or adjusted under 35 U.S.C. 154(b) by 0 days.

(21) Appl. No.: 11/361,547

(22) Filed: Feb. 24, 2006

(65) Prior Publication Data

US 2006/0142091 A1 Jun. 29, 2006

Related U.S. Application Data

(63) Continuation of application No. 10/799,124, filed on Mar. 15, 2004, now Pat. No. 7,150,685.

(51) Int. Cl.
*A63B 53/14* (2006.01)

(52) U.S. Cl. ..... 473/296; 473/300; 473/316

(58) Field of Classification Search ..... 473/294–295, 473/298–299, 296, 300, 306
See application file for complete search history.

(56) References Cited

U.S. PATENT DOCUMENTS 760,161 A * 5/1904 Smith ..... 473/294
1,201,728 A * 10/1916 Henry ..... 473/204
1,419,795 A 6/1922 Yerger
1,561,349 A * 11/1925 Murphy et al. ..... 473/295
1,979,174 A * 10/1934 Robertson ..... 473/204
2,801,106 A * 7/1957 Koehler ..... 473/204
2,984,486 A 5/1961 Jones
3,123,359 A * 3/1964 Lindgren ..... 473/204
3,837,647 A 9/1974 Jacques
4,625,965 A * 12/1986 Mullins ..... 473/204
5,042,804 A 8/1991 Uke et al.
5,125,130 A * 6/1992 Stanish ..... 16/430
5,188,361 A * 2/1993 Coombe ..... 473/294
5,374,064 A * 12/1994 Barber ..... 473/204
5,401,022 A * 3/1995 McCready ..... 473/294
5,474,300 A * 12/1995 Scalise et al. ..... 473/201
5,595,385 A * 1/1997 Jablonski ..... 473/295
5,611,533 A 3/1997 Williams
5,634,859 A * 6/1997 Nesbitt ..... 473/301
5,686,158 A 11/1997 Gibbon
5,730,661 A * 3/1998 Kozub ..... 473/294
5,746,662 A * 5/1998 Squire ..... 473/206
5,792,002 A * 8/1998 Bothwell ..... 473/316
5,944,618 A * 8/1999 Cheng ..... 473/319
6,022,278 A * 2/2000 Vela ..... 473/201
D425,951 S * 5/2000 Davis et al. ..... D21/736
6,599,200 B1 7/2003 Kallassy
7,037,209 B2 * 5/2006 Reece ..... 473/204
2002/0025860 A1 2/2002 Sosin
2004/0176179 A1 * 9/2004 Johnson ..... 473/316
2005/0197201 A1 9/2005 Schoeninger

* cited by examiner

*Primary Examiner*—Stephen Blau
(74) *Attorney, Agent, or Firm*—Kenneth L. Green, Jr.; Edgar W. Averill, Jr.

(57) ABSTRACT

An improved golf club includes an improved grip. The grip may be improved over known grips by including an offset upper portion and/or a sliding grip portion, and/or by providing a shaft with greater flex in an upper shaft portion than in a lower shaft portion. The sliding grip portion is about four inches long and may slide over a standard grip, or over a guide, and is preferably used with putters, but may be used with other golf clubs. The offset upper portion comprises an eleven inch upper grip offset at about nine degrees from the shaft centerline and clocked about 110 degrees counter-clockwise from that face of the head. The lower portion of the grip is retained as in known clubs.

13 Claims, 8 Drawing Sheets

GOLF CLUB

The present application is a Continuation in Part of U.S. patent application Ser. No. 10/799,124, filed Mar. 15, 2004 now U.S. Pat. No. 7,150,685, which application is incorporated herein by reference.

BACKGROUND OF THE INVENTION

The present invention relates to a golf club, and more particularly to a golf club having an improved grip and shaft.

Many golfers have difficulty in developing and maintaining their swing. Playing well requires a consistent swing, and both effort and discomfort reduce consistency. For example, when hitting a ball, a golfer must have good timing to "follow through" not only with arm motion, but with the shoulder motion. The requirement to combine such motion makes consistency all the more difficult. Further, many beginning golfers have extensive experience playing baseball, and are accustomed to a baseball swing and baseball grip. Known golf clubs are not suitable to such baseball swing and grip, and thus golfers are unable to make optimal use of the skeletal, neurological and muscular parts of the body.

What is needed are golf club grips which make it easier to improve timing to follow through with the shoulders, and all parts of the body. A sliding grip and/or a baseball grip and swing, will help the whole body to achieve better timing when the club-head makes impact on the ball.

BRIEF SUMMARY OF THE INVENTION

The present invention addresses the above and other needs by providing a golf club which includes an improved grip. The grip may be improved over known grips by including an offset upper portion and/or a sliding grip portion, and/or by providing a shaft with greater flex in an upper shaft portion than in a lower shaft portion. The sliding grip portion is preferably about four inches long and may slide over or rotate clockwise or counter-clockwise around a standard grip or over a guide, and is preferably used with putters, but may be used with other golf clubs such as woods or irons. The offset upper portion defines an approximately eleven inch long upper grip offset at between about two degrees and about twenty degrees from the shaft centerline, and preferably offset about nine degrees. The offset upper portion is preferably clocked between about ninety two degrees and about one hundred and ten degrees counter-clockwise relative to the face of the head, and more preferably about ninety five degrees counter-clockwise relative to the face of the head. Below the grip portion of irons and woods, the shaft may be made to have smaller diameter, thinner material, or different internal structure than the lower shaft portion, to increase the relative flex of the upper shaft portion, and the upper shaft portion preferably has twice the flex of the lower shaft portion.

In accordance with one aspect of the invention, there is provided an improved golf club comprising a grip, a shaft, a head, and a sliding grip portion adapted to slide on the grip or on a guide or adapted to rotate around the grip or the guide. In one embodiment the sliding grip portion may be limited to slide on an upper grip portion by an upper stop and a lower stop. The sliding grip portion may or may not be keyed to the grip to prevent rotation.

In accordance with another aspect of the present invention, there is provided an improved golf club comprising a head, a shaft, a grip, and an angularly offset grip. The angularly offset grip may be permanently or removably attached to the grip, and may be between six and twelve inches long. The angle between a grip centerline and a centerline of the angularly offset grip is between two degrees and twenty degrees, and the angularly offset grip is clocked counter-clockwise between approximately ninety two degrees and approximately one hundred and ten degrees from a face of the head. A golf club having a angularly offset grip may include a sliding grip portion.

In accordance with still another aspect of the invention directed to irons or woods, there is provided an improved golf club with a shaft having an upper shaft portion with about twice the flex of a lower shaft portion. The desired flex may be obtained by tapering the shaft, by incorporating thicker material into the lower shaft portion, by including internal structure in the lower shaft portion, or a combination of taper, thickness, and internal structure.

In accordance with an additional aspect of the present invention, there is provided a method for using a putter with a sliding upper grip portion. From the point of view of a right handed player. The method comprises grasping the putter with a cross-handed grip (the left hand grasps the grip on or below a stop, or below the sliding grip, and the right hand grasps the sliding grip above the left hand). The player addresses a ball, points the leading left elbow in the desired direction of the ball, and executes a backstroke. He then swings the club towards the ball, and when the club hits the ball, he uses the right hand to pull the sliding grip away from the lower stop, and completes the swing with the follow through by the right shoulder.

In accordance with another aspect of the present invention, there is provided a method for using a golf club with an angularly offset grip portion. The method comprises grasping the angularly offset grip with a normal baseball grip, addressing a ball, pointing the leading elbow in the desired direction of the ball, executing a backstroke, swinging the club towards the ball, hitting the ball, and completing the swing.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
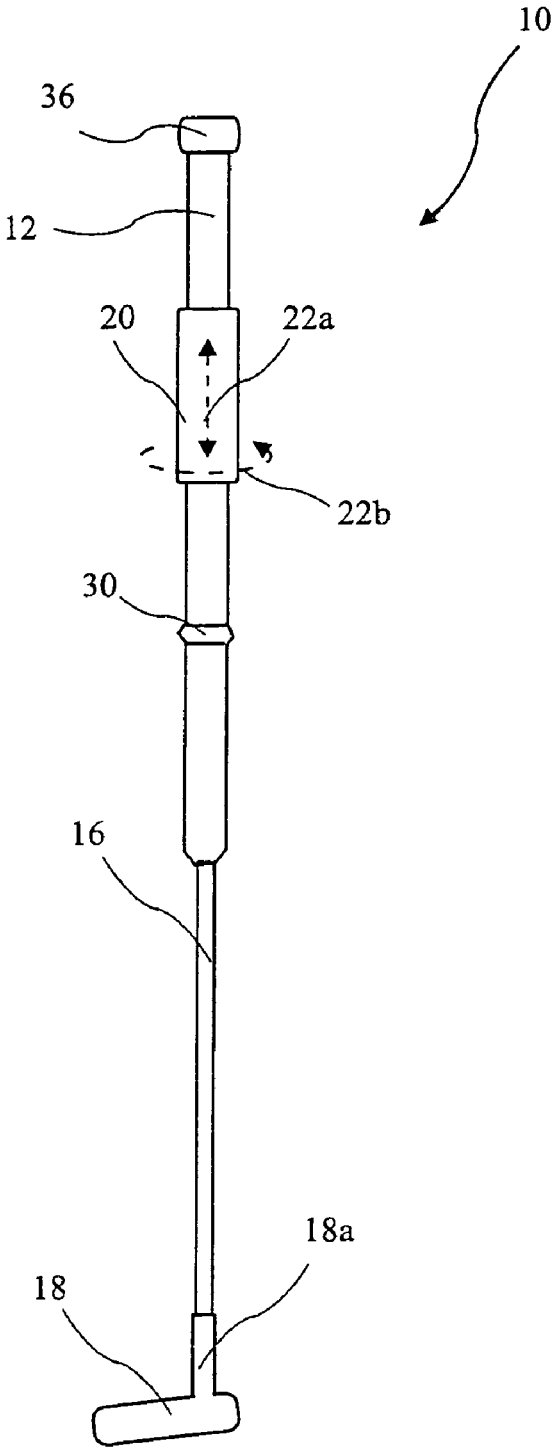
FIG. 1 shows a golf club with a sliding grip portion.
Figure 2:
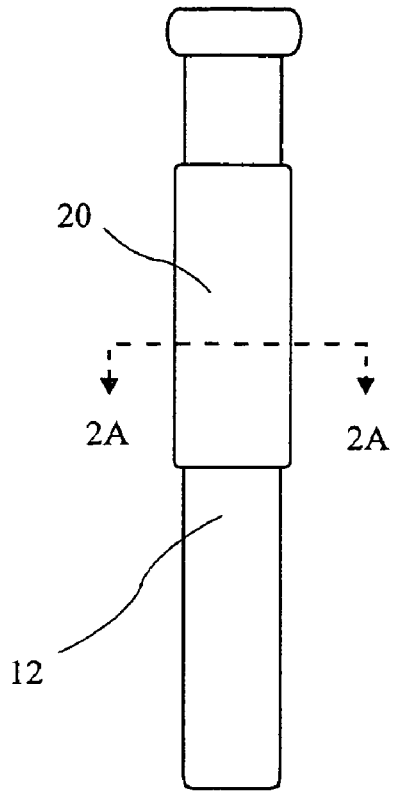
FIG. 2 shows details of the sliding grip portion.
Figure 2A:
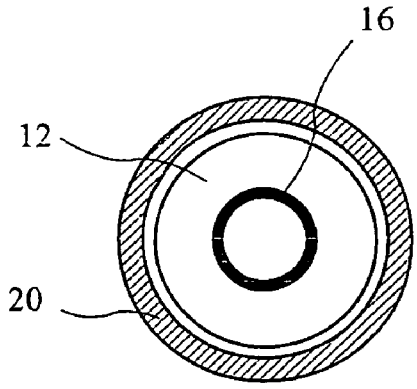
FIG. 2A depicts a cross-sectional view taken along line 2A-2A of FIG. 2 of the cooperation of the sliding grip portion with a guide.

A golf club 10 with a grip 12 is shown in FIG. 1. A shaft 16 extends from the grip 12 to a head 18 suitable for hitting a golf ball. A sliding grip portion 20 slides over the grip 12 as shown by arrow 22 and may rotate about the grip 12. The lower end of the grip 12 can extend anywhere down the shaft 16 to within fourteen inches of a shank 18*a* of the head 18. The sliding grip portion 20 is preferably between approximately three and one half inches long to approximately four and one half inches long, and more preferably approximately four inches long. Further, the sliding grip portion 20 is preferably between approximately one inch in diameter to approximately one and one quarter inches in diameter, and more preferably approximately one inch in diameter, and is preferably approximately one sixteenth inch thick. The sliding grip portion 20 may slide along the grip 12 as shown by arrow 22*a* and rotate about the grip 12 as shown by arrow 22*b*, which sliding is limited by a stop 30. The stop 30 is preferably generally about eighteen inches above the shank 18*a* to accommodate a male player of average height, and in a particular embodiment of the golf club 10 well suited for fairway irons and woods, the stop 30 is about ten inches below a grip upper end 36. A detailed view of the grip 12 is shown in FIG. 2. A cross-sectional view of the grip 12 and sliding grip portion 20 taken along line 2A-2A of FIG. 2 is shown in FIG. 2A.

Figure 3:
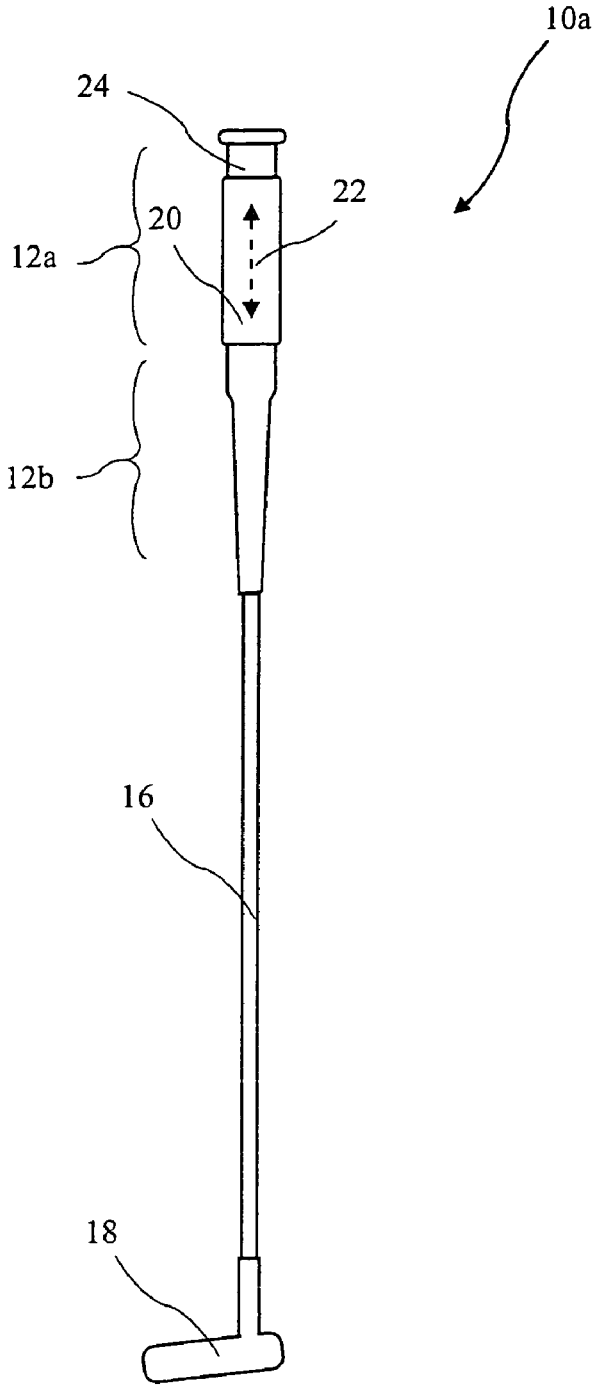
FIG. 3 shows a golf club with a sliding upper grip.

Another embodiment of the present invention is shown by golf club 10*a* including the sliding grip portion 20 in FIG. 3. The club 10*a* includes an upper grip portion 12*a* comprising a guide 24, and a lower grip portion 12*b*. The sliding grip portion 20 travels along the guide 24 as indicated by arrow 22, wherein the travel is preferably approximately two inches to approximately three inches, and more preferably approximately two inches. The lower grip portion 12*b* is preferably between approximately one half inch and one and one quarter inches in diameter, and more preferably approximately one inch in diameter, and may be constant diameter or tapered.

Figure 4:
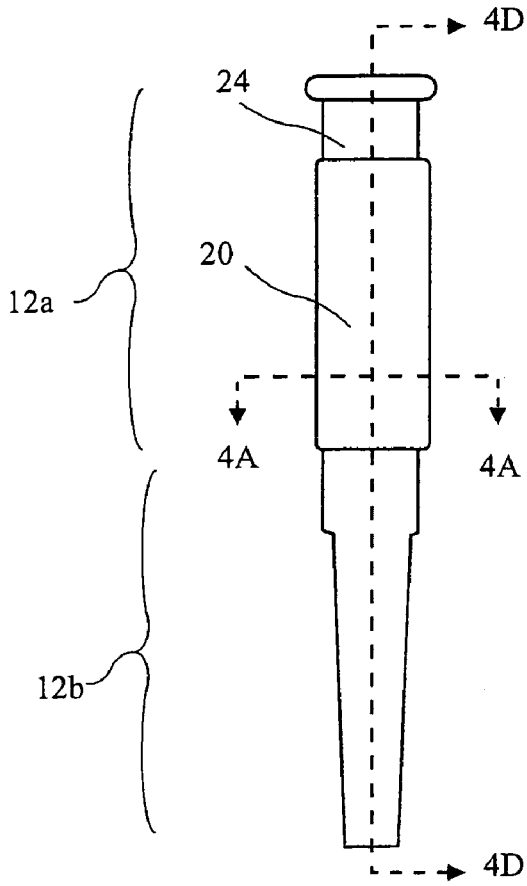
FIG. 4 shows details of the sliding upper grip.
Figure 4A:
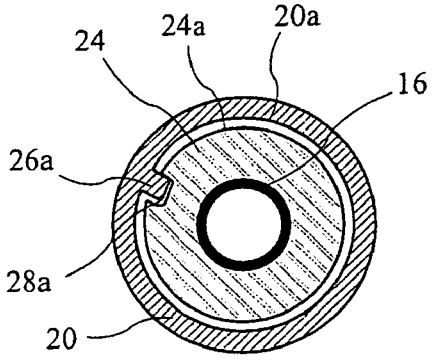
FIG. 4A depicts a cross-sectional view taken along line 4A-4A of FIG. 4 of the cooperation of the sliding upper grip with a guide, wherein a key defined by the sliding upper grip cooperates with a keyway defined by the guide.

A more detailed view of the grip portions 12*a*, 12*b* are shown in FIG. 4. The guide 24 is preferably constant diameter, and preferably approximately six and one quarter inches in length. A cross-sectional view taken along line 4A-4A of FIG. 4, showing a cooperation of the sliding grip portion 20 with the guide 24, is shown in FIG. 4A. The guide 24 includes a first keyway 28*a*, and the sliding grip portion 20 includes a first key 26*a*. The key 26*a* cooperates with the keyway 28*a* to prevent rotation of the sliding grip portion 20 relative to the guide 24. The sliding grip portion 20 includes a smooth inner surface 20*a* and the guide 24 includes a smooth outer surface 24*a* to facilitate sliding the sliding grip portion 20 on the guide 24.

Figure 4B:
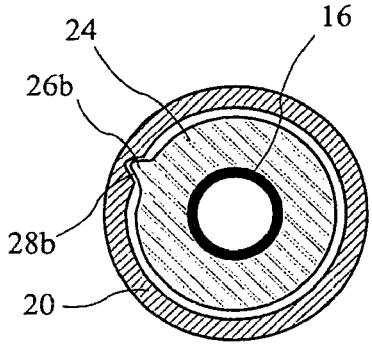
FIG. 4B depicts a cross-sectional view taken along line 4A-4A of FIG. 4 of the cooperation of the sliding upper grip with a guide, wherein a keyway defined by the sliding upper grip cooperates with a key defined by the guide.

A second cross-sectional view taken along line 4A-4A of FIG. 4, showing a cooperation of the sliding grip portion 20 with the guide 24, is shown in FIG. 4B, wherein the sliding grip portion 20 defines a second keyway 28*b*, and the guide 24 defines a second key 26*b*.

Figure 4C:
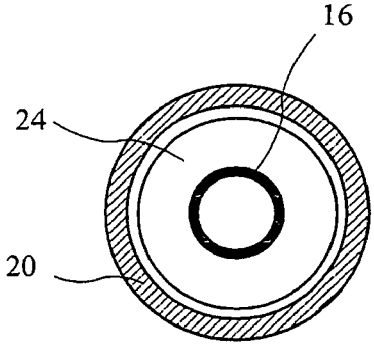
FIG. 4C depicts a cross-sectional view taken along line 4A-4A of FIG. 4 of the cooperation of the sliding upper grip with a guide, wherein the sliding upper grip is free to rotate about the guide.

A third cross-sectional view taken along line 4A-4A of FIG. 4, showing a cooperation of the sliding grip portion 20 with the guide 24, is shown in FIG. 4C, wherein the sliding grip portion 20 is free to rotate about the guide 24.

Figure 4D:
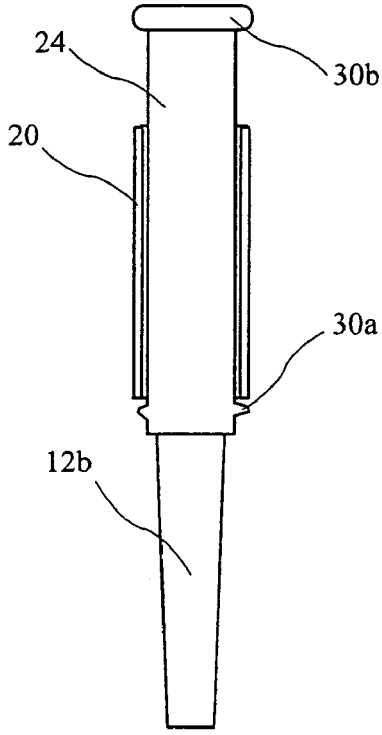
FIG. 4D depicts a cross-sectional view taken along line 4D-4D of FIG. 4 of the cooperation of the sliding upper grip with a guide, wherein the guide includes an upper stop and a lower stop to limit the extent of motion of the sliding upper grip.

A cross-sectional view taken along line 4D-4D of FIG. 4, showing a cooperation of the sliding grip portion 20 with the guide 24, is shown in FIG. 4D. Upper stop 30*b* and lower stop 30*a* are defined on the guide 24, which stops 30*a*, 30*b* limit the travel of the sliding grip portion 20 on the guide 24. The stops 30*a*, 30*b* are preferably between approximately 1/16 and approximately 1/32 of an inch high, and preferably resemble a bead of weld. Although the embodiment described in FIGS. 3 and 4 includes a guide 24, the sliding grip may also slide over an existing grip 12. The sliding grip portion 20 may be used with a variety of golf clubs, for example, a putter, long and short irons, and woods.

Figure 5:
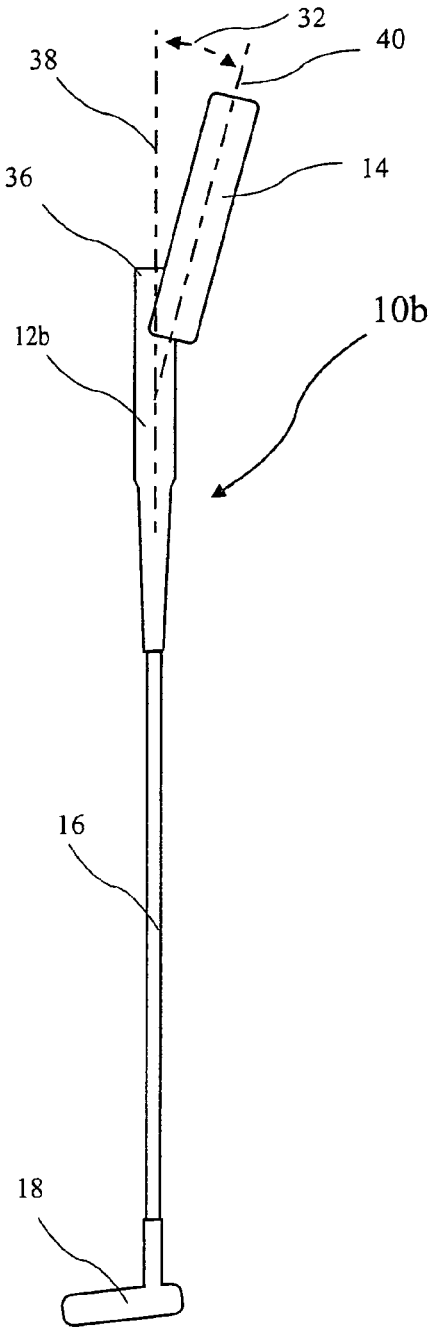
FIG. 5 shows a front view of a golf club with an angularly offset grip.

Yet another embodiment of the present invention is shown by golf club 10*b* including an angularly offset grip 14 as shown in FIG. 5 The angularly offset grip 14 is preferably between approximately five eighths inches and approximately one and one half inches in diameter and more preferably one inch in diameter, and is preferably between approximately eight inches and approximately twelve inches long, and more preferably approximately eleven inches long and preferably extends approximately eight inches beyond the grip upper end 36.

The offset grip 14 is attached to the lower grip 12*b* near the grip upper end 36, and a centerline 40 of the offset grip 14 is laterally offset by angle 32 from the centerline 38 of the shaft 16. The angle 32 is preferably between approximately two degrees and approximately twenty degrees, and is more preferably approximately 14 degrees. The offset grip centerline 40 preferably intersects the shaft centerline 38 between approximately two inches to approximately four inches from the grip upper end 36, and more preferably approximately three inches from the grip upper end 36.

The offset grip 14 may be permanently attached to the lower grip 12*b*, or be a removable offset grip 14 thereby allowing the offset grip 14 to be adjusted to difference positions and angles on the lower grip 12*b*, to be switched between clubs, or to be removed to allow easier storage of clubs. The offset grip 14 resides substantially above the lower grip 12*b* such that an upper hand may grasp the offset grip 14 and a lower hand may grasp the lower grip 12*b* when the club is in use. For example, there may be some overlap between grips 12*b* and 14, or the offset grip 14 may be attached to a portion of the shaft 16 extending though the lower grip 12*b*.

Figure 5A:
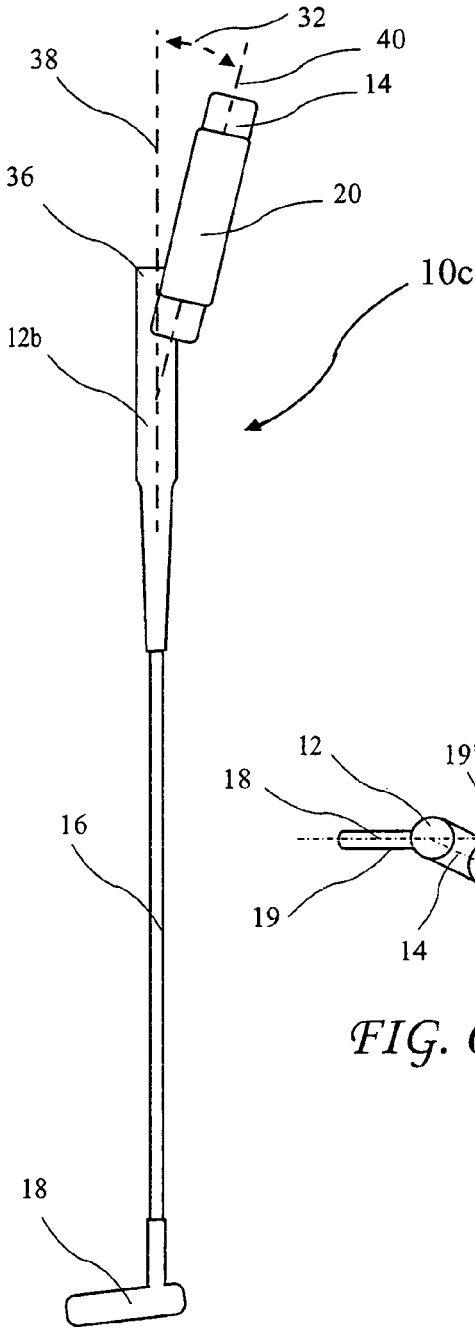
FIG. 5A shows a front view of a golf club with the angularly offset grip and the sliding grip portion.

A golf club 10*c* having both the offset grip 14 and the sliding grip portion 20 is shown in FIG. 5A. The sliding grip portion 20 may slide on the offset grip 14, or on the grip 12, and may be keyed or may freely rotate.

Figure 6:
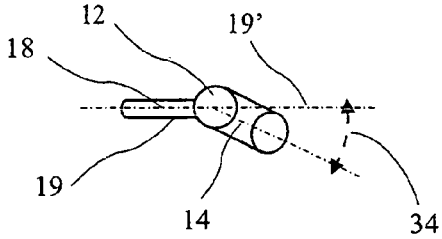
FIG. 6 shows a top view of the golf club with an angularly offset grip.

A top view of the club 10*b* looking down along a line-of-sight approximately aligned with the shaft 16 is shown in FIG. 6. The head 18 includes a face 19 for hitting the golf ball. The offset grip 14 is clocked clockwise (or forward) by a clocking 34, from the centerline 19' of head 18, which centerline 19' is approximately parallel to the face 19. The angularly offset grip 14 is preferably clocked forward between approximately zero degrees and approximately 45 degrees from a centerline 19' of the head 18, and the offset grip 14 is more preferably clocked forward approximately twelve degrees from the centerline 19' of the head 18, wherein zero degrees clocking corresponds to the offset grip 14 pointing opposite the head 18 and positive rotations are clockwise and ahead of the face 19.

The grip 12 of the golf club 10*b* may be a standard grip as used on known golf clubs, or may be between nine and ten inches long, have a width between one half inch and one and one quarter inches and preferably one inch, and may be constant width.

Figure 7A:
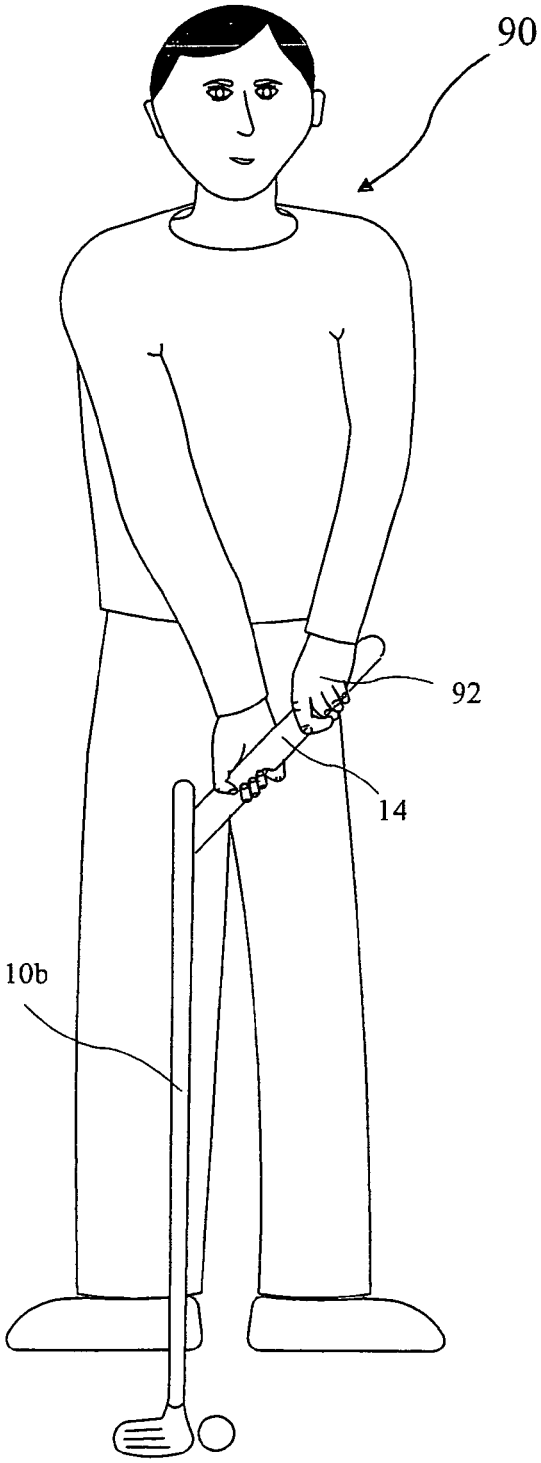
FIG. 7A is a front view of a golfer using a baseball grip with the offset grip golf club.
Figure 7B:
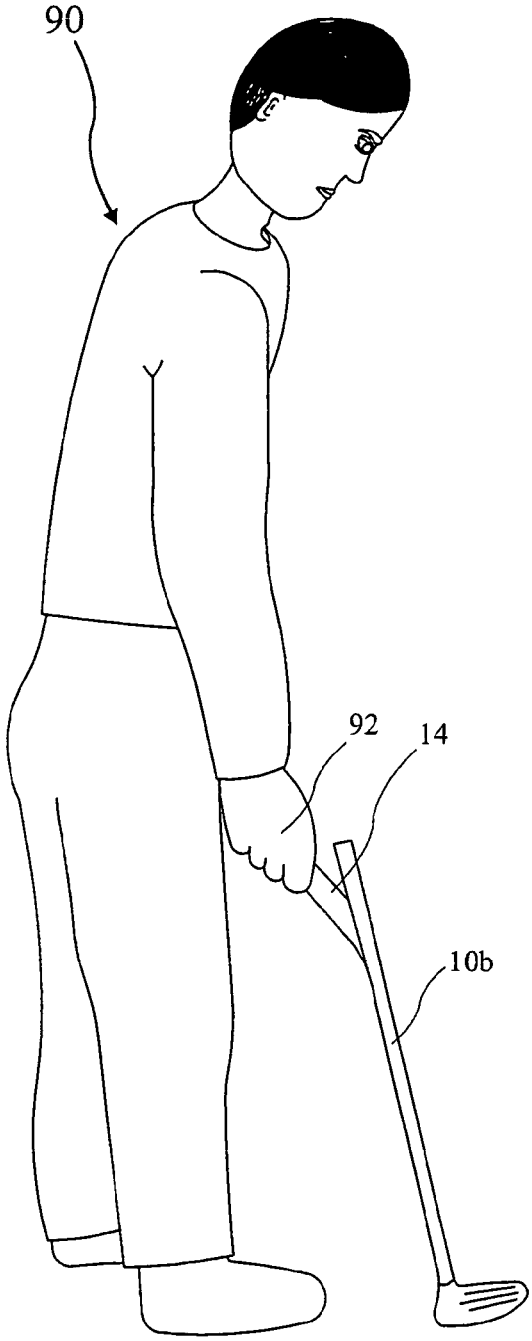
FIG. 7B is a side view of the golfer using the baseball grip with the offset grip golf club.
Figure 8A:
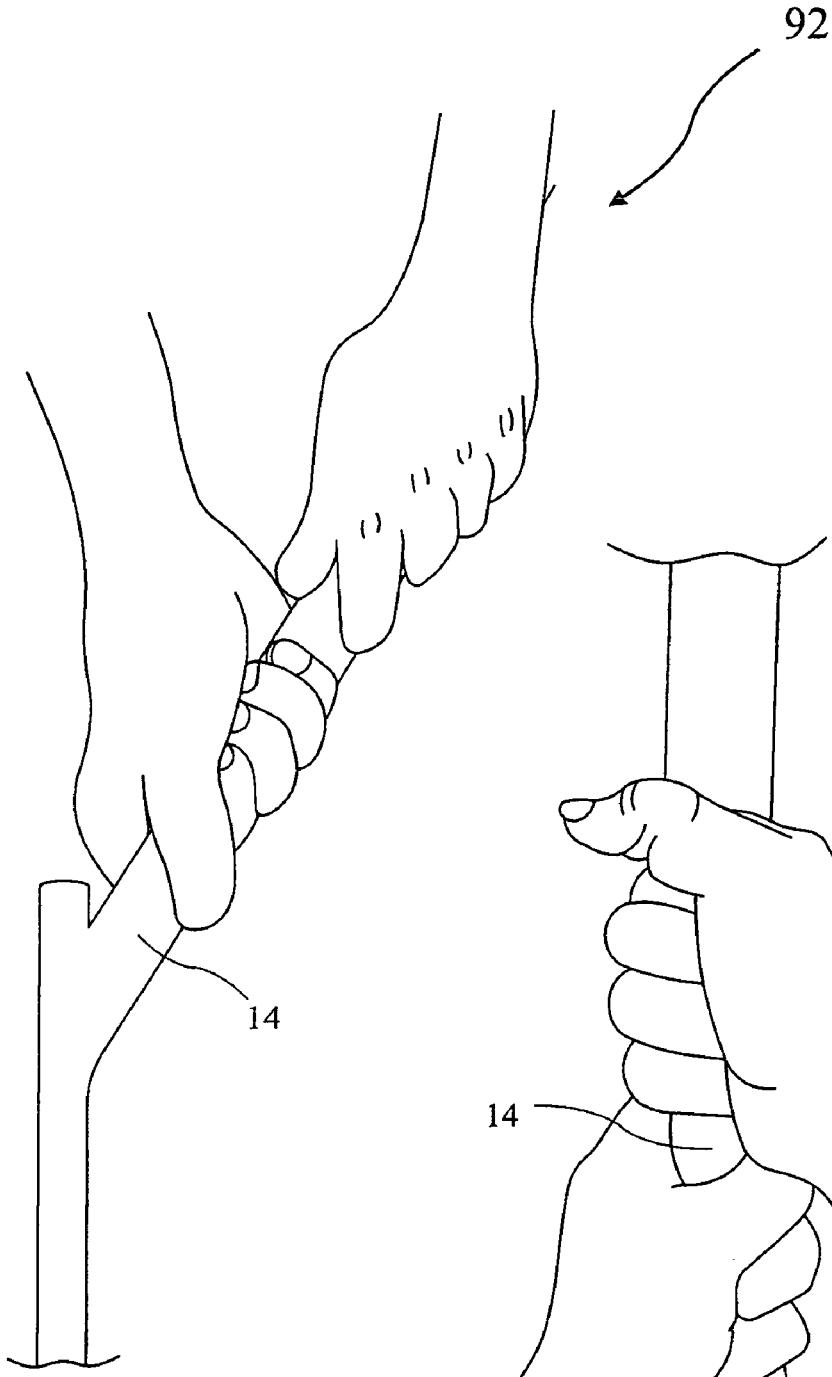
FIG. 8A is a detailed front view of the baseball grip with the offset grip golf club.
Figure 8B:
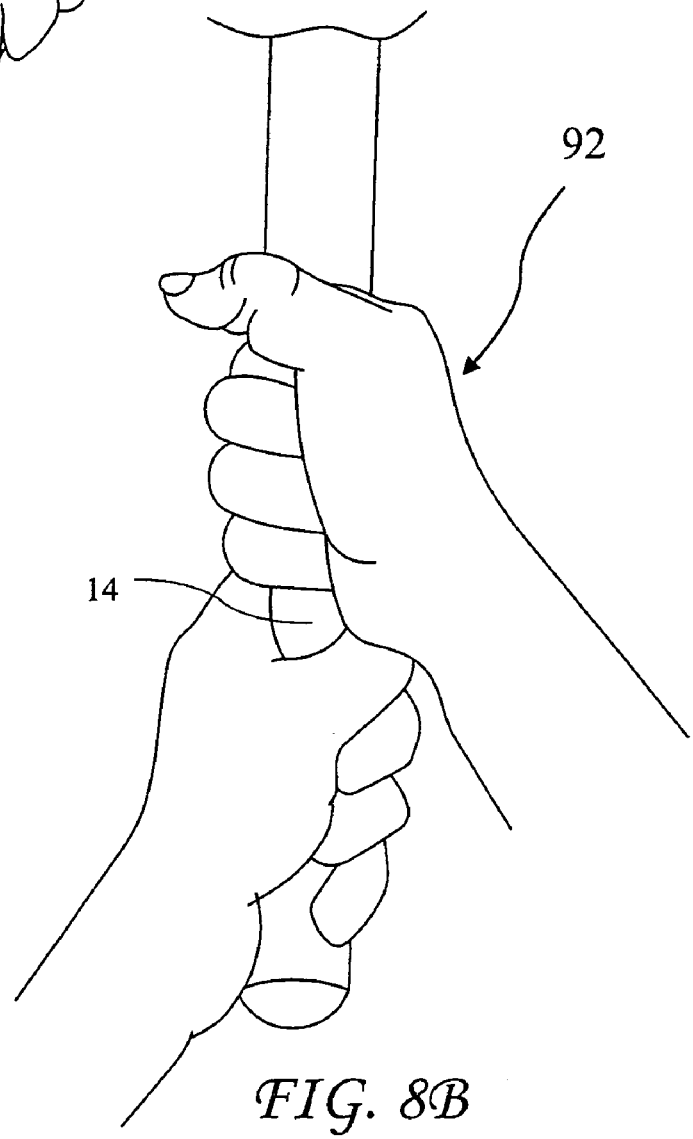
FIG. 8B is a detailed top view of the baseball grip with the offset grip golf club.

A front view of a golfer 90 using a baseball grip with the offset grip golf club 10*b* (see FIG. 5) is shown in FIG. 7A, and a side view of the golfer 90 using the baseball grip with the offset grip golf club 10*b* is shown in FIG. 7B.

A detailed front view of the baseball grip used with the offset grip golf club 10*b* is shown in FIG. 11A, and a detailed top view of the baseball grip used with the offset grip golf club 10*b* is shown in FIG. 11B. The hands 92 thus grasp the offset grip 14 in a natural and familiar manner.

The purpose of the Offset Grip 14 is to allow a golfer to take advantage of the common American experience of using a baseball bat. While growing up, from childhood through adulthood, most Americans at one or more times have stood at the "plate" to hit a pitched ball with a baseball bat. The offset grip golf club 10*b* attempts to "marry" that common experience of the baseball swinging to the technique of golf swinging. The offset grip golf club 10*b* is preferably a "Driver" otherwise known as the "1 Wood," and may further be a "2, 3, and 4 Wood". Although the gripping and swinging of the offset grip golf club 10*b* may require some practice for those who are accustomed to using a straight shaft, the acclimation period is generally brief because of the natural feel of a baseball swing. Copying the baseball grip, both hands 92 are placed on the offset grip 14 (see FIG. 5) which grip 14 preferably has a diameter similar to a baseball bat rather than the smaller diameter of the common golf club.

Besides giving the golfer comfort and security in gripping the club, the offset grip 14 provides swinging stability to the golfer. This is particularly important when making and controlling the "backswing" because the hands and the arms are lifted up and away from the motionless "addressing" position. Furthermore, the grip on the offset grip 14 can help stabilize and control the tremendous centrifugal force created by the return downward/forward swing and the continued "follow-through" swing. The purpose of the "forward offset" (see angle 34 in FIG. 6) is to help the golfer 90 control the flight of the golf ball. The "Offset" is also angled slightly forward in order to inhibit the over-turning of the left hand during and after the time the club head makes contact with the ball which can result in hitting severe "duck-hook" shots. On the other hand, the "forward offset," because it does inhibit the excessive use of the left hand, can allow the player to concentrate on using the entire left side of the body in accordance to the instructions of golf professionals. Furthermore, it would permit a golfer to narrow his or her range of concentration for bringing into action the right side of the body to provide more force into the shot at the critical point when the right hand and arm are at the bottom of the "downswing." In other words, at that most crucial moment when the "forward offset" has reached swinging through its initial area when the ball was "addressed," the golfer may concentrate on powering with his or her right hand and right arm "through the ball" to the target without fearing that he or she will over-hook the ball during its flight.

By following the sequence as described, golfers will have better "timing" in using both sides of the body, starting with the left side to dominate the swing, and instead of having the right arm and hand being "tamed down," confidently completing the swing with the right side applying more force than the right side is usually made to give. The purpose for the extension to be "offset" at an angle toward a golfer's midsection, that is, besides it having been angled forward, is to keep the hands and arms closer to the body rather than having them "reach" for the ball, an action which would cause them to become extended farther away from the body. By being closer to the body when the ball is addressed, and by being closer to the body when the full swing is executed, the swinging arc can better be stabilized and controlled.

Figure 9:
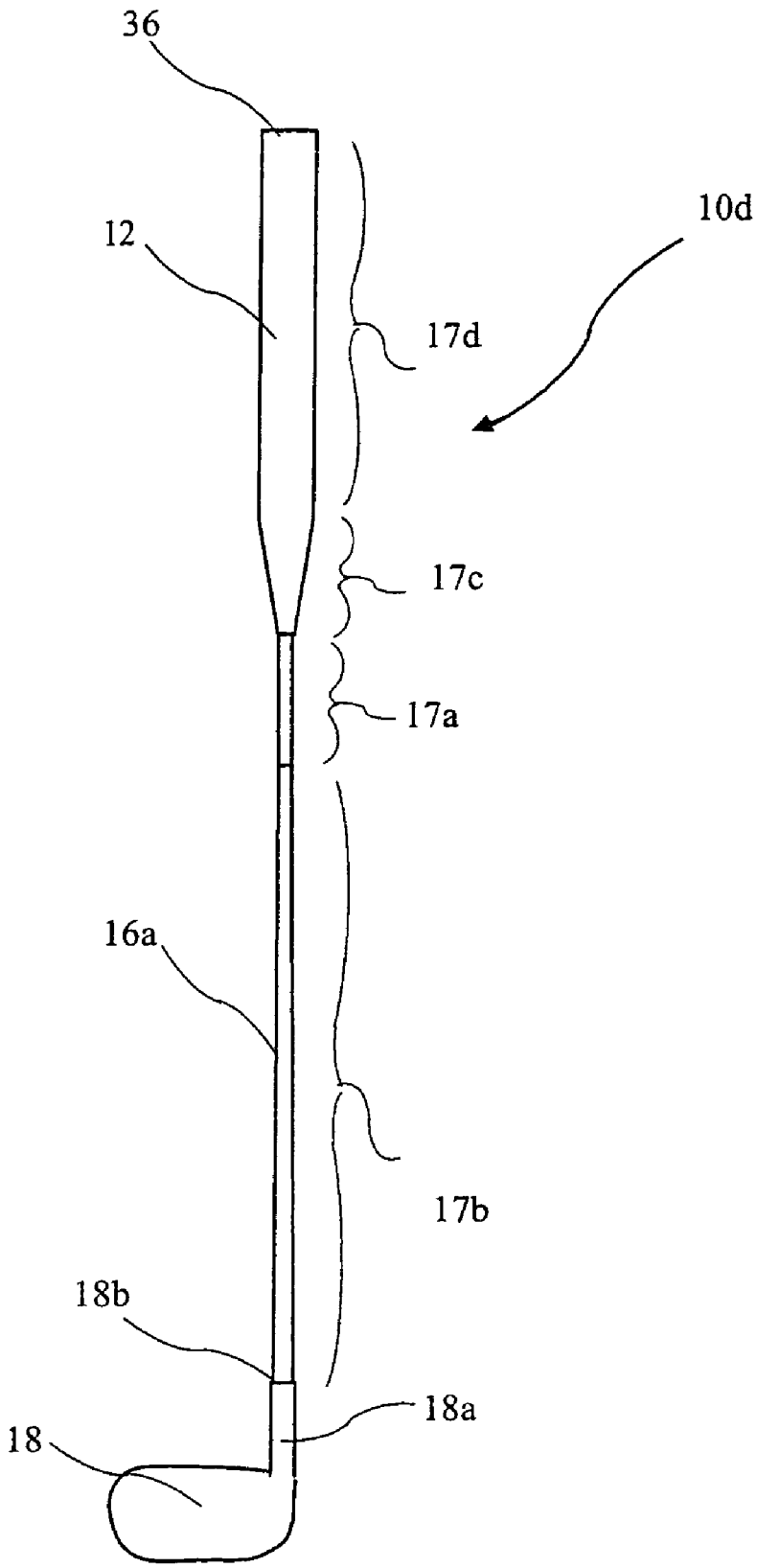
FIG. 9 shows a front view of a golf club with a shaft adapted to provide greater flex in an upper shaft portion than in a lower shaft portion.

A golf club 10*d*, preferably an iron or wood, with a second shaft 16*a* having an upper shaft portion 17*a* with greater flex, and preferably twice the flex, of a lower shaft portion 17*b* is shown in FIG. 9. The desired flex may be obtained by tapering the shaft 16*a*, by incorporating thicker material into the lower shaft portion 17*b*, by including internal structure in the lower shaft portion 17*b*, or a combination of taper, thickness, and internal structure. The shaft 16*a* may be fabricated with the desired flex, or may be modified after fabrication by fusing additional material, for example metal, fiber-glass, or the like, onto or into the lower shaft portion 17*b*. For example, an aluminum tube may be fused between the shank 18*a* and a point about twenty inches below the shaft top. As another example, a half tube (i.e., a tube split length-wise) may be fused to one side of the shaft 16*b* from the shank 18*a* to a point about twenty inches below the shaft top.

Preferably, the greater flex of the upper shaft portion 17*a* is obtained by tapering the shaft 16*a*, wherein the shaft 16*a* tapers from its widest diameter at a junction 18*b* with the shank 18*a*, to its narrowest diameter, preferably at a point twelve to twenty inches below the grip upper end 36. The narrowest diameter of the shaft 16*a* is more preferably at the upper shaft portion 17*a* which is about three inches in length and located between fourteen inches and sixteen inches below the grip upper end 36. A tapered grip portion 17*c* extends from the upper shaft portion 17*a* to within about ten inches of the grip upper end 36, wherein a straight grip portion 17*d* extends from the tapered grip portion 17*c* to the grip upper end 36, which straight grip portion 17*c* is preferably approximately one inch in diameter. The lower shaft portion 17*b* preferably reduces in diameter between the shank junction 18*b* (largest diameter) to the upper shaft portion 17*a* (smallest diameter), and the upper shaft portion

17*a* preferably has approximately the same diameter as the smallest diameter of the lower shaft portion 17*b*.

An embodiment of the golf club 10 of FIG. 1 in which the sliding grip portion 20 is not keyed (i.e., can rotate about the grip 12 or guide 24), and the stopper 30 is about ten inches below the grip upper end 36, is used by a right handed player as follows. Upon addressing the ball, there is no cross-handed placement of the hands. This means that the left hand is positioned on the highest portion of the grip 12, and the right hand is placed on the moving grip portion 20 below the left hand. There is no interlocking of the two hands and no interlocking of the fingers of the two hands. It is essential that the two hands will function somewhat independently. The left hand grasps the grip 12 firmly, and the right hand grasps the sliding grip portion 20 less firmly.

When the club is taken back primarily by the left side of the body, and left arm and hand, the right hand on the sliding grip portion 20 may or may not fractionally slide up toward the left hand, and may or may not rotate fractionally counter-clockwise until the hands cock over the right shoulder to be ready for the return downswing. On the return downswing, the force is primarily from the left side of the body, and arm and hand, but at the point of impact with the ball, the right hand on the sliding grip portion 20 deliberately should be fractionally rotated clockwise. This action by the right hand will help eliminate the common trend of players to tighten the right hand on their club's grip at the point of impact, a tendency which distorts the timing and the hitting surface off the club's alignment to the direction intended.

Figure 10:
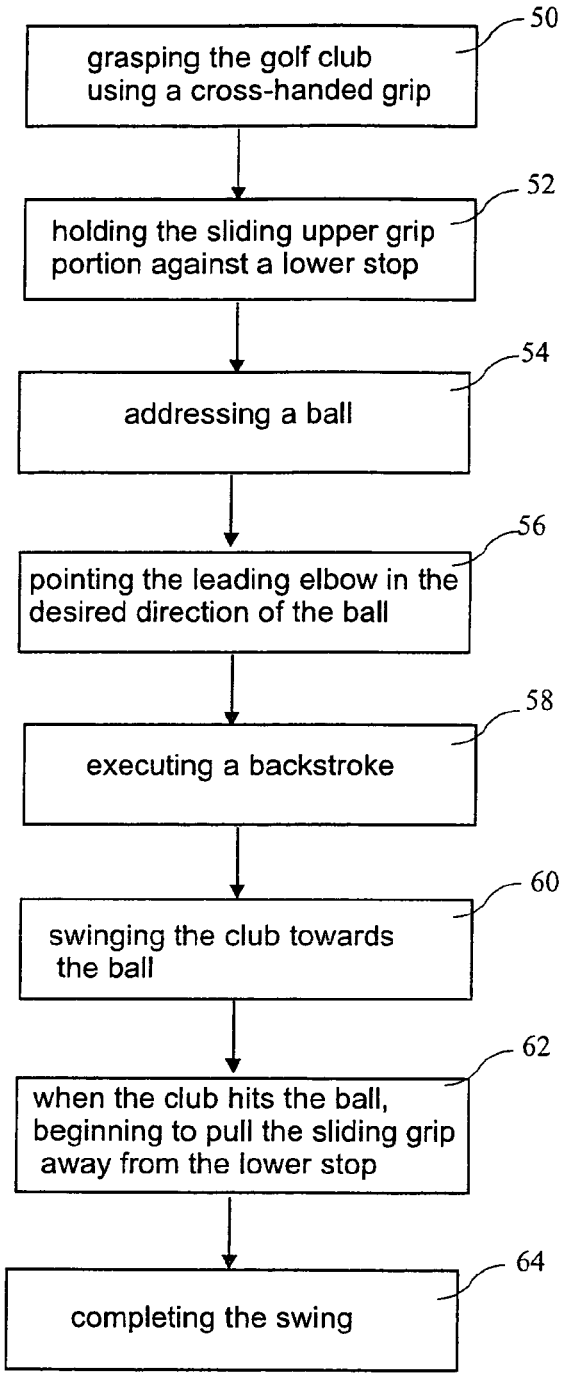
FIG. 10 depicts a method of use of a golf club with a sliding grip.

A method for using a putter with a sliding upper grip portion to create a lag stroke is described in FIG. 10. The sliding grip provides numerous options for performing the lag stroke, and the following is a preferred option. The left arm and left side of the body provide the power for the lag stroke. The method comprises grasping the putter using a cross-handed grip at step 50. A cross handed grip for a right handed golfer would place the golfer's right hand on the sliding grip portion and the left hand on the stationary lower grip portion. The method further includes holding the sliding grip portion with the right hand against a lower stop at step 52, addressing a ball at step 54, pointing the leading elbow in the desired direction of the ball at step 56, executing a backstroke at step 58, swinging the club towards the ball at step 60, when the club hits the ball, beginning to pull the sliding grip away as vertically as possible from the lower stop at step 62, and completing the swing with minimum shoulder follow-through at step 64.

Figure 11:
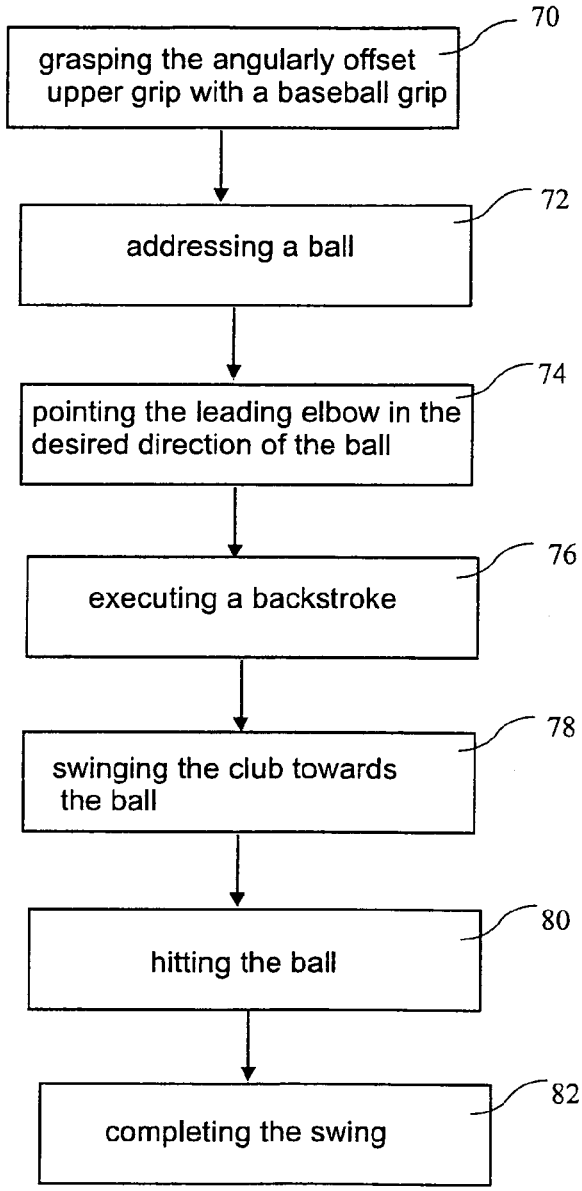
FIG. 11 depicts a method of use of a golf club with an angularly offset grip.

A method for using a golf club with an angularly offset grip portion is described in FIG. 11. The method comprises grasping the angularly offset grip using a normal baseball grip at step 70, addressing the ball at step 72, pointing the leading elbow in the desired direction of the ball at step 74, executing a backstroke wherein the left arm is pushing and the right arm is pulling the club back and around the right shoulder whereby the right hand and the left hand will be "cocked" at the top of the backstroke at step 76, swinging the club towards the ball with the left side of the body, left arm, and left hand leading at step 78, hitting the ball at 80, and completing the swing a at step 82.

Those parameters which are opposite for right versus left hand players have been provided above for a right handed player, and the scope of the present invention is intended to include the corresponding values for a left handed player.

While the invention herein disclosed has been described by means of specific embodiments and applications thereof, numerous modifications and variations could be made thereto by those skilled in the art without departing from the scope of the invention set forth in the claims.

I claim:

1. An improved golf club comprising:

a head having a face for hitting a golf ball;

a shaft connected to the head, the shaft extending upward from the head;

an angularly offset grip extending from the shaft at an end opposite the head, the angularly offset grip laterally offset at a fixed angle between approximately two degrees and approximately twenty degrees from a centerline of the shaft; and a fixed clocking of the angularly offset grip of approximately twelve degrees from a centerline of the head, wherein zero degrees clocking corresponds to the offset grip pointing opposite from the head and positive rotations are clockwise and ahead of the face, when looking down at the club with a line-of-sight approximately aligned with the shaft.

2. The golf club of claim 1, wherein the angularly offset grip is between approximately five eighths inches and approximately one and one half inches in diameter.

3. The golf club of claim 1, wherein the angularly offset grip is approximately one and one half inches in diameter.

4. The golf club of claim 1, wherein the angularly offset grip is between approximately six inches long and approximately twelve inches long.

5. The golf club of claim 4, wherein the angularly offset grip is approximately eleven inches long.

6. The golf club of claim 1, wherein the fixed angle is approximately fourteen degrees from the centerline of the shaft.

7. The golf club of claim 1, wherein the shaft has an upper end, and wherein a centerline of the angularly offset grip intersects a shaft centerline of the shaft between approximately one inch to approximately five inches from the upper end.

8. The golf club of claim 1, wherein the golf club is an iron.

9. The golf club of claim 1, wherein the golf club is a wood.

10. An improved golf club comprising:

a head having a face for hitting a golf ball;

a lower grip;

a shaft connecting the lower grip to the head; and an angularly offset grip between approximately eight inches and approximately 12 inches in length and attached to the lower grip, the angularly offset grip laterally offset at a fixed angle, wherein the fixed angle is between approximately two degrees and approximately twenty degrees from a centerline of the shaft, and the angularly offset grip is clocked forward at a fixed clocking of approximately twelve degrees from a centerline of the head, zero degrees clocking pointing opposite from the head and positive rotations are clockwise and ahead of the face, when looking down at the club with a line-of-sight approximately aligned with the shaft.

11. The golf club of claim 10, wherein the angularly offset grip is offset at the fixed angle of approximately fourteen degrees from a centerline of the shaft.

12. The golf club of claim 10, wherein the angularly offset grip is laterally offset at a fixed angle of approximately 14 degrees from a centerline of the shaft.

13. An improved golf club comprising:

a head having a face for hitting a golf ball;

a shaft connected to the head, the shaft extending upward from the head;

an angularly offset grip between approximately eight inches and approximately 12 inches in length and extending from the shaft at an end opposite the head, the angularly offset grip laterally offset at a fixed angle of approximately 14 degrees from a centerline of the shaft; and a clocking wherein the angularly offset grip is clocked forward at a fixed clocking of approximately 12 degrees from a centerline of the head, zero degrees clocking pointing opposite from the head and positive rotations are clockwise and ahead of the face, when looking down at the club with a line-of-sight approximately aligned with the shaft.

* * * * *